US005819488A

United States Patent [19]

Jones

[11] Patent Number: 5,819,488

[45] Date of Patent: Oct. 13, 1998

[54] FINISH FLOOR COVERING UTILIZING SINGLE PLY TILES

[76] Inventor: Craig S. Jones, 47421 Brent Ct., Chesterfield, Mich. 48047

[21] Appl. No.: 581,440

[22] Filed: Dec. 29, 1995

[51] Int. Cl.[6] ..... E04F 13/08

[52] U.S. Cl. ..... 52/392; 52/390

[58] Field of Search ..... 52/390, 391, 392

[56] References Cited

U.S. PATENT DOCUMENTS

| | | | |
|---|---|---|---|
| 0,857,718 | 6/1907 | Calkins | 52/392 X |
| 1,614,127 | 1/1927 | Heppes | 52/392 X |
| 1,662,456 | 3/1928 | De Vol | 52/392 X |
| 1,749,563 | 3/1930 | Chamberlain | 52/177 X |
| 1,841,370 | 1/1932 | Grigsby | 52/392 |
| 2,049,778 | 12/1936 | Mowery | 52/181 |
| 3,500,606 | 3/1970 | Wharmby | 52/392 X |
| 3,740,914 | 6/1973 | Arnaiz Diez | 52/392 X |
| 4,953,335 | 9/1990 | Kawaguchi et al. | 52/392 X |
| 5,238,721 | 8/1993 | Nakazawa | 52/392 X |
| 5,283,102 | 2/1994 | Sweet et al. | 52/392 X |
| 5,362,560 | 11/1994 | Ehrhart et al. | 52/392 X |
| 5,408,001 | 4/1995 | Nakahata et al. | 525/199 |

*Primary Examiner*—Christopher Kent
*Assistant Examiner*—Yvonne Horton-Richardson
*Attorney, Agent, or Firm*—Lyon, P.C.

[57] ABSTRACT

A relatively permanent and indestructible covering (10) utilizes a plurality of single ply tiles (12) which are bonded to a base floor surface (14) and provided with a protective coating in a single step by applying at least one protective bonding coating, such as an epoxy coating, over the top of plurality of tiles. To facilitate bonding to base floor surface, each of the plurality of tiles (12) are formed with a plurality of holes passing through the surface thereof. A color finish coating can also be provided over the top of the array of tiles by utilizing a protective bonding coating having a paint or paint-like quality. In a preferred embodiment, the tiles (12) are formed from a metal such as aluminum.

1 Claim, 1 Drawing Sheet

FINISH FLOOR COVERING UTILIZING SINGLE PLY TILES

BACKGROUND OF THE INVENTION

The present invention relates generally to industrial type finish floor coverings, and more specifically to a finish floor covering having improved durability and longevity.

Generally speaking, industrial/commercial type facilities are typically constructed with a base floor or subfloor surface comprising a concrete slab. Due to the high amount of wear and tear inherent in the use of these facilities, industrial/commercial finish floor coverings are applied to the base floor surfaces to provide a kind of prophylactic barrier for the base floor surface. In addition, a finish floor covering can function as a safety element by providing a nonskid surface for the base floor surface, and by adding a color scheme to the base floor surface, may also provide a further element of safety to the facility. Still further, a finish floor covering can provide an important aesthetic quality to the base floor surface.

Existing industrial/commercial finish floor coverings typically use a combination of layers of paint and epoxy-type coatings. While these floor coverings provide a desirable aesthetic/safety quality, their durability is very limited, typically lasting on the order of 2–5 years before requiring labor intensive resurfacing. Thus, existing finish floor coverings also suffer the drawback of requiring almost constant maintenance over the life of the facility. In addition, optimal durability requires the base floor surfaces to be clean and relatively free of imperfections. Therefore, existing finish floor coverings do not easily lend themselves to application to old and/or worn base floor surfaces without requiring substantial amounts of time and labor in preparing the base floor surface prior to application of the finish coatings.

SUMMARY OF THE INVENTION

It is therefore an object of the present invention to provide an improved finish floor covering and method for producing the same which has significantly higher durability than conventional industrial floor finishes and which can be satisfactorily applied to old and/or worn floor surfaces.

It is another object of the present invention to provide a relatively permanent finish floor covering and method for producing the same for use on industrial type base floor surfaces which is easy to install and requires little maintenance.

It is another object of the present invention to provide a relatively permanent finish floor covering which allows a protective, coloring, and adhesive process to be performed in a single step.

In accordance with these and other objects, a first aspect of the present invention provides a durable finish floor covering for use with an industrial type base floor surface comprising a plurality of single ply tiles positioned on the base floor surface in a substantially abutting relation so as to form an array configuration, and at least one protective bonding coating applied over the top of the array of tiles. In a preferred embodiment, the protective bonding coating comprises at least one layer of epoxy, each of the single ply tiles comprise an aluminum tile having a plurality of holes passing through the surface thereof, and the at least one protective bonding coating is formed to provide a color coating over the top of the tiles.

In accordance with a second aspect of the present invention, a process for providing a durable floor finish comprises the steps of positioning a plurality of single ply tiles on a base floor surface so that the plurality of tiles are in a substantially abutting relation to form an array configuration covering the base floor surface, and applying at least one protective bonding coating over the top of the array of tiles to affix the tiles to the base floor surface. The process further provides that the at least one protective bonding coating be formed to further provide a color coating over the top of the array of tiles.

The present invention will be more fully understood upon reading the following detailed description of the preferred embodiment in conjunction with the accompanying drawings.

DETAILED DESCRIPTION OF THE PREFERRED EMBODIMENT(S)

Figure 1:
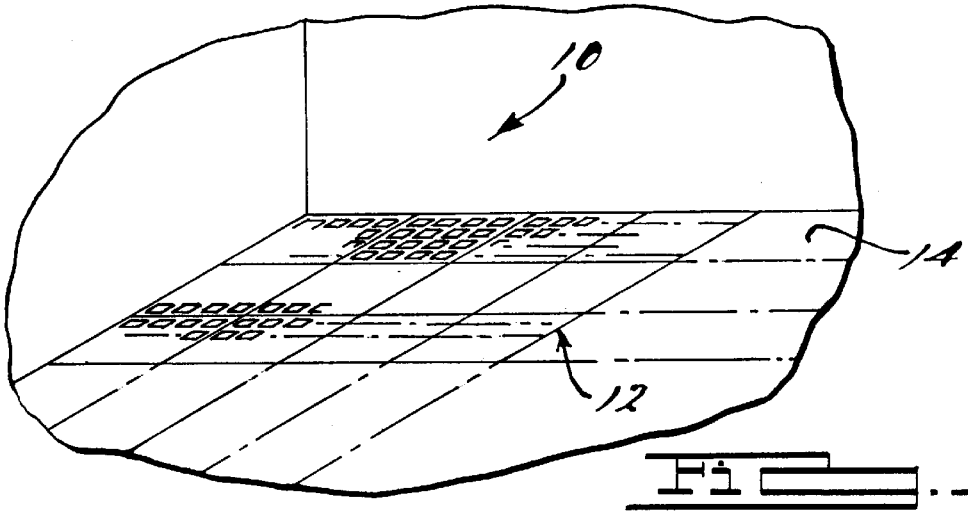
FIG. 1 is a perspective view of a finish floor covering in accordance with the present invention.
Figure 2:
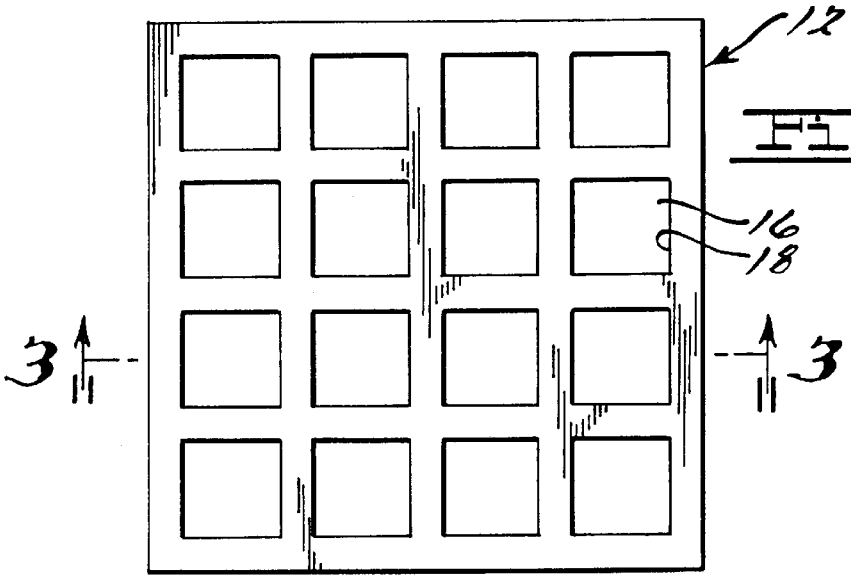
FIG. 2 is a top view of a single ply metal floor tile in accordance with a preferred embodiment of the present invention.

As illustrated in FIGS. 1 and 2, the present invention comprises a finish floor covering 10 consisting of a plurality of individual single ply floor tiles 12 affixed with at least one protective bonding coating 16 layer to a base floor surface 14, such as a conventional concrete slab floor utilized in a commercial building, factory, or warehouse. In a preferred embodiment, the single ply tiles are formed from aluminum, and further include a plurality of holes 18 passing through the surface thereof, such as by stamping in a waffle-like pattern shown in FIG. 2. However, one of ordinary skill in the art will readily appreciate that the choice of single ply material used to form the tiles, the pattern of the holes, and the method of forming the holes can take the form of a number of alternative arrangements. For example, alternative metals or even a plastic or fiberglass material could be used to form the tiles, and instead of stamped or punched out surface holes or indentations, a plurality of holes can be drilled through the surface of each individual tile, such as in a swiss cheese-like pattern.

It is to be noted that one principal feature of the present invention is the use of single ply "tiles." In one arrangement, these tiles will have a dimension of 16 ⅞ in.×16 ⅞ in. (≈43 cm×43 cm), or 16 ⅞ in.×8 ft. (≈43 cm×2.5 m), but one of ordinary skill in the art will readily appreciate that the actual size and shape of the tile can be varied as desired, with the key feature being that the "tiles" have a size and weight which facilitate easy handling and/or installation by a crew of one or two individuals. For example, the tile can be provided with a width of up to 48 inches (≈122 cm).

Figure 3:
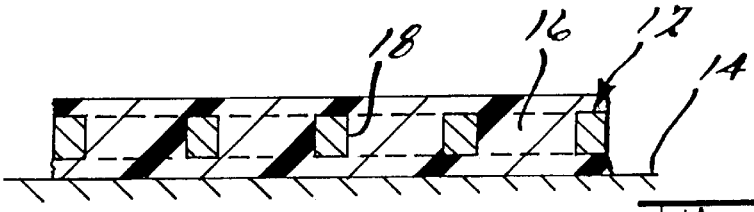
FIG. 3 is a cross section of FIG. 2 taken along the line 3—3.

Referring now to FIG. 3, the present invention provides an installation process for producing a finish floor covering which allows the plurality of tiles 12 to be protected, colored (i.e. painted) and affixed to a properly prepared base floor surface 14 in a single step. More specifically, the tiles 12 are positioned on the base floor surface 14 in an array configuration, wherein the positioning can be augmented by temporarily tacking the tiles 12 to the floor 14 with an adhesive glue. Then at least one thin coat of suitable protective bonding material 16, such as an epoxy is applied over the top of the array of the tiles 12, particularly coating the plurality of holes 18. The application of the protective bonding epoxy coating 16 can be accomplished such as by squeegeeing the epoxy over the array of tiles. The epoxy is forced to flow between each of the respective tiles, and/or underneath the tiles, which causes adhesion of the tiles 12 to the base floor 14. Once the epoxy coating 16 is set, a relatively permanent and indestructible finish floor covering is effectively produced. In addition, since each of the holes 18 forms a "pocket" for the colored epoxy, even if the epoxy coating 16 is severely abraded from the top surface of the tiles, a substantial portion of each tile is able to retain its painted appearance and nonslip properties.

Figure 4:
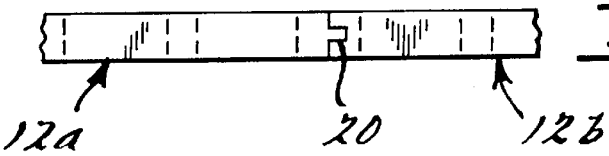
FIG. 4 is a side view of two interlocked floor tiles.

Referring now to FIG. 4, an alternative embodiment of the single ply tiles 12 is shown wherein the edges of each tile is formed to facilitate interlocking with at least one adjoining tile when installed. For example, the tiles 12 can be formed to include a tongue-and-groove 20 arrangement, whereby the tongue of a tile 12(*a*) is inserted into the groove of an adjoining tile 12(*b*). However, it is noted that this arrangement is not to be construed as limiting since the interlocking arrangement can be implemented in any manner known to one having ordinary skill in the art.

It will be understood that the foregoing description of the preferred embodiment of the present invention is for illustrative purposes only, and that the various structural and operational features herein disclosed are susceptible to a number of modifications, none of which departs from the spirit and scope of the present invention as defined in the appended claims.

I claim:

1. In combination with a horizontal floor surface;

a plurality of flat, metal, tiles having edges disposed in an edge abutting array on said floor surface, each of said tiles having a plurality of apertures extending laterally therethrough and spaced from the edges thereof, each of said tiles being of uniform thickness between the apertures therein and between the apertures and the edges thereof, and;

a protective and bonding coating overlying the entire array of tiles and extending through the apertures in each of said tiles into contact with said floor surface whereby said tiles are bonded to said floor surface and loaded solely in compression by loads placed on said tiles.

* * * * *